US011295654B2

(12) United States Patent
Wang

(10) Patent No.: US 11,295,654 B2
(45) Date of Patent: Apr. 5, 2022

(54) DELAY ADJUSTMENT CIRCUIT AND METHOD, AND DISPLAY DEVICE

(71) Applicant: HKC Corporation Limited, Guangdong (CN)

(72) Inventor: Mingliang Wang, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/041,820

(22) PCT Filed: Nov. 26, 2018

(86) PCT No.: PCT/CN2018/117375
§ 371 (c)(1),
(2) Date: Sep. 25, 2020

(87) PCT Pub. No.: WO2020/087605
PCT Pub. Date: May 7, 2020

(65) Prior Publication Data

US 2021/0027689 A1 Jan. 28, 2021

(30) Foreign Application Priority Data

Oct. 30, 2018 (CN) ..... 201811280289.1

(51) Int. Cl.
*G09G 3/20* (2006.01)

(52) U.S. Cl.
CPC ..... *G09G 3/20* (2013.01); *G09G 2310/0275* (2013.01); *G09G 2310/08* (2013.01); *G09G 2330/08* (2013.01); *G09G 2370/00* (2013.01)

(58) Field of Classification Search
CPC ..... G09G 2310/08; G08G 2370/00; G08G 2370/08
See application file for complete search history.

(56) References Cited

U.S. PATENT DOCUMENTS 5,867,541 A * 2/1999 Tanaka ..... H04L 7/0337 375/354
9,886,897 B2 2/2018 Dan et al.
(Continued)

FOREIGN PATENT DOCUMENTS

CN 1540912 A 10/2004
CN 1710508 A 12/2005
(Continued)

OTHER PUBLICATIONS

International Search Report for Application No. PCT/CN2018/117375, dated Jul. 31, 2019, 4 pages.
(Continued)

*Primary Examiner* — William Boddie
*Assistant Examiner* — Bipin Gyawali
(74) *Attorney, Agent, or Firm* — Hauptman Ham, LLP

(57) ABSTRACT

A delay adjustment circuit, comprising: a detection circuit configured to output a control signal upon detecting a data signal edge; a timing circuit configured to obtain a setup time and a hold time according to the control signal; a computation circuit configured to perform a computation with respect to a plurality of setup times and a plurality of hold times so as to obtain time information of a row data signal; and an adjustment circuit configured to correspondingly adjust, according to the time information and a preset relative time delay, a relative time delay between an output data signal and a clock signal.

16 Claims, 4 Drawing Sheets

(56) References Cited

U.S. PATENT DOCUMENTS

| | | | | |
|---|---|---|---|---|
| 2003/0208717 | A1* | 11/2003 | Klotchkov | G01R 31/3191 714/814 |
| 2009/0274254 | A1* | 11/2009 | Hirata | H04L 7/0091 375/371 |
| 2011/0037758 | A1 | 2/2011 | Lim et al. | |
| 2014/0185725 | A1 | 7/2014 | Best et al. | |
| 2015/0229314 | A1* | 8/2015 | Hata | H03L 7/07 327/218 |
| 2018/0183975 | A1* | 6/2018 | Horibe | G09G 3/3685 |
| 2019/0258287 | A1* | 8/2019 | Fu | G06F 1/08 |
| 2019/0297372 | A1* | 9/2019 | Sato | G06F 11/325 |

FOREIGN PATENT DOCUMENTS

| | | | |
|---|---|---|---|
| CN | 101042843 | A | 9/2007 |
| CN | 101473587 | A | 7/2009 |
| CN | 105139826 | A | 12/2015 |
| CN | 107731173 | A | 2/2018 |

OTHER PUBLICATIONS

Chinese Office Action for Application No. 201811280289.1, dated Mar. 4, 2020, 9 pages.
Chinese Office Action for Application No. 201811280289.1, dated Aug. 12, 2020, 9 pages.

* cited by examiner

DELAY ADJUSTMENT CIRCUIT AND METHOD, AND DISPLAY DEVICE

CROSS REFERENCE TO RELATED APPLICATIONS

This application is a U.S. National Stage application of, and claims priority to, PCT/CN2018/117375, filed Nov. 26, 2018, which further claims priority to Chinese Patent Application No. 20181128089.1, filed Oct. 30, 2018, the entire contents of which are incorporated herein in their entirety.

TECHNICAL FIELD

This application relates to a delay adjustment circuit and method, and a display device.

BACKGROUND

The description herein provides only background information related to this application, but does not necessarily constitute the prior art.

With the increase of the size and resolution of liquid crystal display televisions, data to be transmitted is increased day by day. Therefore, differential signals used as a high-speed transmission protocol are popularized, and data transmission quality faces more severe challenges. Under a condition that data transmission amplitudes (corresponding to a high level and a low level of data) meet the requirement, a relative time between a clock signal and a data signal is also important.

However, as the quantity of differential pairs increases, driver boards become increasingly thinner, and data to be transmitted increases, the data transmission quality becomes worse. In practical application, a data transmission error is caused because the relative time is usually too short. Then, it consumes much time and labor for manual debugging in order to ensure that the relative time between the clock signal and data signal meets the requirement. In addition, in the face of the constantly changing transmitted data, it is unable to ensure the correct receiving for each batch of data.

SUMMARY

According to various embodiments of this application, a delay adjustment circuit and method and a display device are provided.

A delay adjustment circuit includes:

a detection circuit configured to output a first control signal when a first data signal edge is detected, output a second control signal when a clock signal edge is detected, output a third control signal when a second data signal edge is detected, and execute the step repeatedly;

a timing circuit connected to the detection circuit and configured to start timing according to the first control signal, stop timing according to the second control signal, restart timing at a time of recording timing data as a set-up time, stop timing according to the third control signal, and record the timing data as a holding time;

a calculation circuit connected to the timing circuit and configured to calculate a plurality of set-up time and a plurality of holding time to obtain time information of a row data signal; and an adjustment circuit connected to the calculation circuit and configured to correspondingly adjust and output a relative delay time between a data signal and a clock signal according to the time information and a preset relative delay time.

In an embodiment, the delay adjustment circuit further includes:

a storage circuit connected to the calculation circuit and configured to store the time information.

In an embodiment, the delay adjustment circuit further includes:

a communication circuit connected between the calculation circuit and the adjustment circuit and configured to establish a communication connection between the calculation circuit and the adjustment circuit and transmit the time information.

In an embodiment, the communication circuit further includes a bidirectional communication protocol.

In an embodiment, the communication circuit further includes an inter-integrated circuit ($I^2C$) protocol.

In an embodiment, the timing circuit further includes a counter.

In an embodiment, the first data signal edge and the second data signal edge are edges of two adjacent data signals in a data transmission process.

In an embodiment, the clock signal edge is a signal edge between the first data signal edge and the second data signal edge in a data transmission process.

In an embodiment, the row data signal is a set of all data signals transmitted in a preset time.

In an embodiment, the preset relative delay time includes a preset set-up time and a preset holding time.

A display device includes a display panel and the delay adjustment circuit described above.

A delay adjustment method includes steps of:

outputting a first control signal when a first data signal edge is detected, outputting a second control signal when a clock signal edge is detected, outputting a third control signal when a signal edge of a second data signal is detected, and executing the step repeatedly;

starting timing according to the first control signal, stopping timing according to the second control signal, restarting the timing at a time of recording timing data as a set-up time, stopping timing according to the third control signal, and recording the timing data as a holding time;

calculating a plurality of set-up time and a plurality of holding time to obtain time information of a row data signal; and correspondingly adjusting and outputting a relative delay time between a data signal and a clock signal according to the time information and a preset relative delay time.

In an embodiment, the step of outputting a first control signal when a first data signal edge is detected, outputting a second control signal when a clock signal edge is detected, outputting a third control signal when a signal edge of a second data signal is detected, and executing the step repeatedly specially includes:

outputting the first control signal when the first data signal edge is detected, outputting the second control signal when the clock signal edge is detected, and outputting the third control signal when the signal edge of the second data signal is detected; and executing the step repeatedly at a period of the detection of the first data signal edge, the clock signal edge and the second data signal edge.

In an embodiment, after the step of calculating a plurality of set-up time and a plurality of holding time to obtain time information, the method includes:

storing the time information.

In an embodiment, after the step of calculating a plurality of set-up time and a plurality of holding time to obtain time information, the method includes:

establishing a communication connection, and transmitting the time information.

In an embodiment, the step of establishing a communication connection, and transmitting the time information specifically includes:

establishing a communication connection, and storing the time information in real time; or establishing a communication connection, and transmitting the time information when the data signal transmission is stopped.

In an embodiment, a calculation method includes at least one of a mean value method and a weighting method.

Details of one or more embodiments of this application are provided in the following accompanying drawings and descriptions. Other features and advantages of this application will become apparent from the specification, the accompanying drawings, and the claims.

BRIEF DESCRIPTION OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person skilled in the art may still derive other drawings from these accompanying drawings without creative efforts.

DETAILED DESCRIPTION OF THE EMBODIMENTS

To make the technical solutions and advantages of this application clearer and more comprehensible, the following further describes this application in detail with reference to the accompanying drawings and embodiments. It should be understood that the specific embodiments described herein are merely used to explain this application but are not intended to limit this application.

Figure 1:
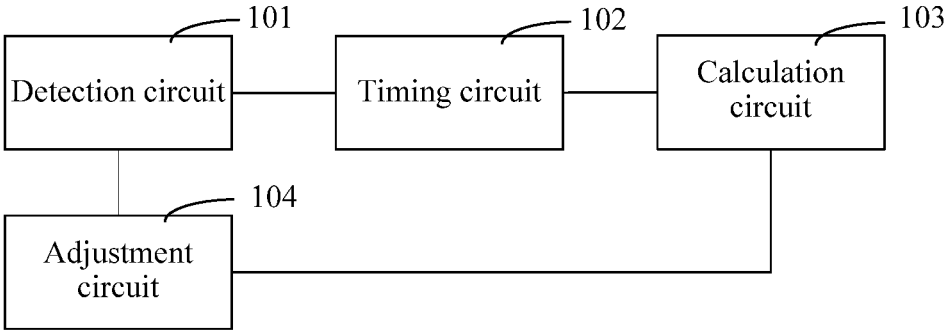
FIG. 1 is a structural diagram of a delay adjustment circuit according to an embodiment.

Referring to FIG. 1, FIG. 1 is a structural diagram of a delay adjustment circuit according to an embodiment;

In this embodiment, the delay adjustment circuit includes: a detection circuit 101, a timing circuit 102, a calculation circuit 103, and an adjustment circuit 104. The detection circuit 101, the timing circuit 102, and the calculation circuit 103 are disposed at a data transmission receiving end, and the adjustment circuit 104 is disposed at a data transmission transmitting end. In an embodiment, the detection circuit 101, the timing circuit 102, and the calculation circuit 103 of the delay adjustment circuit are disposed in a data driver, and the adjustment circuit 104 is disposed in a timing controller.

The detection circuit 101 is configured to output a first control signal when a first data signal edge is detected, output a second control signal when a clock signal edge is detected, output a third control signal when a second data signal edge is detected, and execute the step repeatedly.

The timing circuit 102 is connected to the detection circuit 101 and configured to start timing according to the first control signal, stop timing according to the second control signal, restart timing at a time of recording timing data as a set-up time, stop timing according to the third control signal, and record the timing data as a holding time.

The calculation circuit 103 is connected to the timing circuit 102 and configured to calculate a plurality of set-up time and a plurality of holding time to obtain time information.

The adjustment circuit 104 is connected to the calculation circuit 103 and configured to correspondingly adjust and output a relative delay time between a data signal and a clock signal according to the time information and a preset relative delay time.

In this embodiment, the detection circuit 101 is located at the data transmission receiving end, and configured to receive a data signal and a clock signal transmitted in a differential pair, automatically detect each data signal and clock signal, and output a control signal when a data signal edge and a clock signal edge are detected. Specifically, the detection circuit 101 outputs the first control signal when the first data signal edge is detected, outputs the second control signal when the clock signal edge is detected, outputs the third control signal when the second data signal edge is detected, and executes the step repeatedly at a period of the detection of the first data signal edge, the clock signal edge and the second data signal edge. The number of periods can be set specifically according to actual data signal transmission quality.

The first data signal edge and the second data signal edge are edges of two adjacent data signals in a data transmission process, which include a rising edge and a falling edge. More specifically, the edges may be edges of adjacent display data signals in a display data transmission process. The clock signal edge is a signal edge between the first data signal edge and the second data signal edge in a clock signal transmission process, and specifically is an effective edge of a clock signal. The first control signal, the second control signal and the third control signal are signals output by the detection circuit 101 and set as trigger signals for the timing circuit 102 to execute corresponding starting timing, stopping timing and recording time and meanwhile restarting timing, and stopping timing respectively.

In this embodiment, the timing circuit 102 is configured to start timing according to a control signal output by the detection circuit 101, specifically, start timing according to the first control signal, stop timing according to the second control signal, restart timing at the time of recording timing data as a set-up time ($T_S$), stop timing according to the third control signal, and record the timing data as a holding time ($T_H$). The timing circuit 102 records a plurality of groups of set-up time and holding time data by periodically executing steps of starting timing, stopping timing and resetting at the same time, then restarting timing and stopping timing, and finally obtaining a relative delay status between the plurality of groups of data signals and the clock signals of the data transmission receiving end. The set-up time ($T_S$) specifically refers to a time for which the data signal keep stable and constant before a clock signal rising edge arrives. The holding time ($T_H$) specifically refers to a time for which data keeps stable and constant after the clock signal rising edge arrives.

In this embodiment, the calculation circuit 103 is configured to calculate a plurality of set-up time and a plurality of holding time to obtain time information of a row data signal, and feed the time information back to the adjustment circuit 104.

The row data signal refers to a set of all data signals transmitted in a preset time which is set according to an actual transmission condition and the accuracy of the time information to be obtained. The plurality of set-up time may be equal or not, and the plurality of holding time may be equal or not. A calculation method includes but is not limited to a mean value method and a weighting method, and a combination thereof. The time information specifically refers to a relative delay status between a row data signal and a clock signal received by the data transmission receiving end, which includes but is not limited to a mean value or a weighted mean value of the plurality of set-up time, and a mean value or a weighted mean value of the plurality of holding time. For example, the mean value method may be adopted to calculate and obtain the mean value of the plurality of set-up time, specifically, $T_S=(T_1+T_2+\ldots+T_N)/N$. N is a positive integer and may be set according to actual situations.

The time information can be fed back in real time by the calculation circuit 103 to the adjustment circuit 104, so that real-time and accurate adjustment may be realized to improve the delay accuracy. Alternatively, the time information may be selectively fed back in a non-data transmission period, that is, in an idle time in a horizontal or vertical direction, to avoid impact on data transmission.

Figure 2:
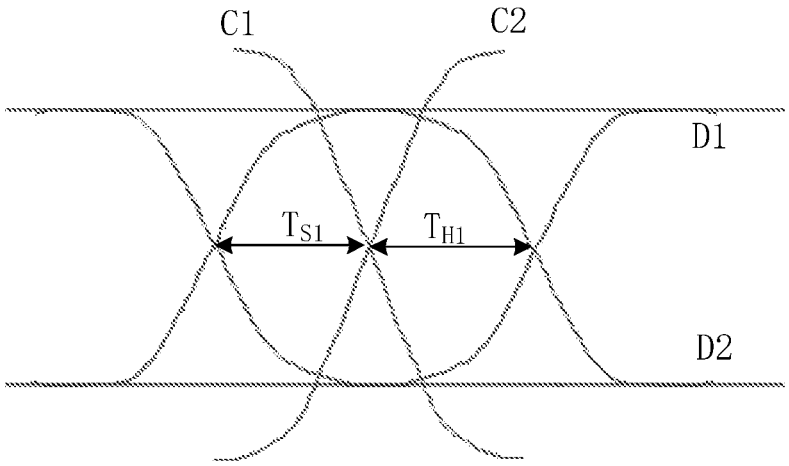
FIG. 2 is a data transmission diagram.
Figure 3:
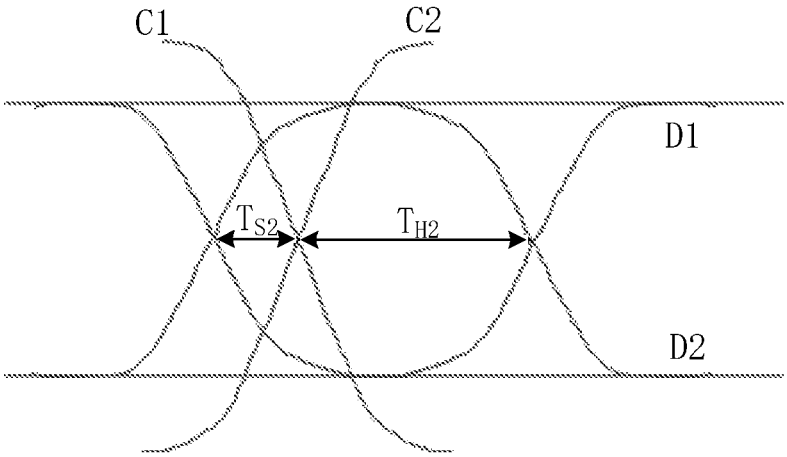
FIG. 3 is another data transmission diagram.

In this embodiment, the adjustment circuit 104 is located at the data transmission transmitting end, and configured to receive the time information fed back by the calculation circuit 103 and correspondingly adjust, according to the time information, the relative delay time between the data signal and the clock signal output by the data transmission transmitting end, so that the relative delay time meets the requirement of the preset relative delay time, and the data transmission receiving end can reliably collect data. Meanwhile, excessive manual debugging is not needed with the help of automatic adjustment so as to save time and labor. The preset relative delay time includes a preset set-up time and a preset holding time, which are set under different data transmission statuses in the actual application to meet the requirement of the data transmission diagram (eye diagram) under various data transmission statuses. For example, referring to FIG. 2 and FIG. 3 (curves D1 and D2 in the figure are data signal curves, and curves C1 and C2 are clock signal curves), in FIG. 2, $T_{S1}$ and $T_{H1}$ are the preset set-up time and the preset holding time respectively corresponding to a data transmission status; in FIG. 3, $T_{S2}$ and $T_{H2}$ are a mean value of a plurality of set-up time and a mean value of a plurality of holding time that are respectively obtained by the calculation circuit 103 under an identical data transmission status. As $T_{S2}$ is excessively smaller than $T_{S1}$, and the data transmission transmitting end continually outputs the data signal with the set-up time $T_{S2}$, data may be transmitted incorrectly. Therefore, the set-up time of outputting the data signal and the clock signal is correspondingly adjusted to the $T_{S1}$.

The delay adjustment circuit provided by this embodiment includes the detection circuit 101, the timing circuit 102, the calculation circuit 103, and the adjustment circuit 104. The data signal edge and the clock signal edge are detected automatically by the detection circuit 101, the timing circuit 102 is controlled to record the plurality of groups of set-up time and holding time, the plurality of groups of set-up time and holding time are calculated by the calculation circuit 103 to obtain and feed back the time information of the data transmission receiving end, so that the adjustment circuit 104 correspondingly adjusts, according to the time information and the preset relative delay time, the relative delay time between the data signal and the clock signal output by the data transmission transmitting end, so that the relative delay time meets the requirement of the preset relative delay time, and the data transmission receiving end can reliably collect data, thereby improving data transmission quality. Different preset relative delay time may be selected adaptively according to different data transmission statuses, to realize adaptive dynamic matching and meet the eye diagram requirements under different data transmission statuses. Meanwhile, excessive manual debugging is not needed with the help of automatic adjustment so as to save time and labor.

Figure 4:
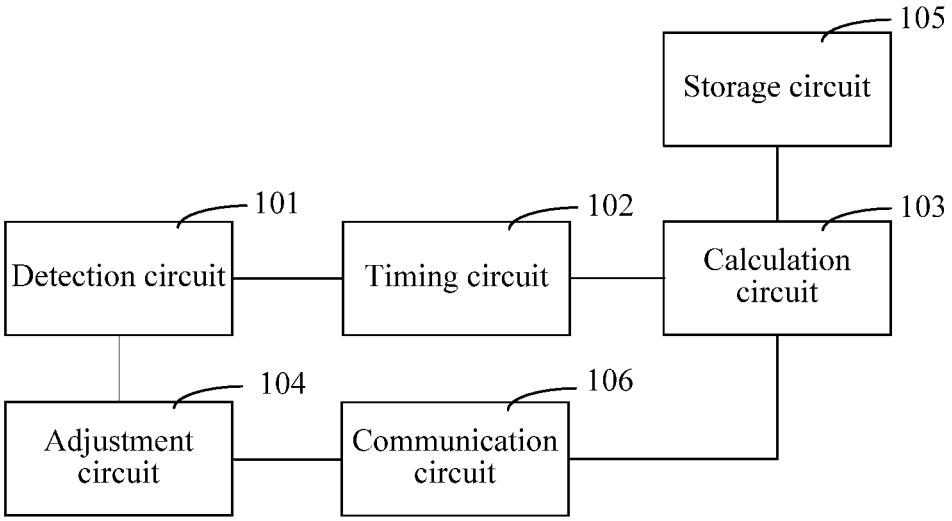
FIG. 4 is a structural diagram of a delay adjustment circuit according to another embodiment.

Referring to FIG. 4, FIG. 4 is a structural diagram of a delay adjustment circuit according to another embodiment.

In this embodiment, the delay adjustment circuit includes: a detection circuit 101, a timing circuit 102, a calculation circuit 103, an adjustment circuit 104, a storage circuit 105, and a communication circuit 106.

In this embodiment, for related descriptions of the detection circuit 101, the timing circuit 102, the calculation circuit 103, and the adjustment circuit 104, refer to the previous embodiment, and no more detailed description will be given herein.

In this embodiment, the storage circuit 105 is connected to the calculation circuit 103 and configured to store time information. On one hand, the time information is stored by the storage circuit 105 to avoid loss of the time information; on the other hand, the time information may be fed back by the calculation circuit 103 to the adjustment circuit 104 in real time or in a non-data transmission period. Therefore, more time information can be stored in the storage circuit 105 for feedback, and a response is made immediately when the time information needs to be fed back, thereby improving the time information extraction efficiency.

In this embodiment, the communication circuit 106 is configured to establish a communication connection between the calculation circuit 103 and the adjustment circuit 104 and transmit the time information. Specifically, the communication circuit 106 can comply with a bidirectional communication protocol, which includes but not limited to an $I^2C$ protocol. During application of the communication protocol, lines of the communication protocol and to-be-transmitted data are separated and do not interfere with each other, so that the time information can be transmitted in real time when data are transmitted to achieve real-time accurate adjustment.

The delay adjustment circuit provided by this embodiment includes the detection circuit 101, the timing circuit 102, the calculation circuit 103, the adjustment circuit 104, the storage circuit 105, and the communication circuit 106. The data signal edge and the clock signal edge are detected automatically by the detection circuit 101, the timing circuit 102 is controlled to record the plurality of groups of set-up time and holding time, the plurality of groups of set-up time and holding time are calculated by the calculation circuit 103 and the storage circuit 105, the time information is obtained and stored, and the time information of the data transmission receiving end is fed back by the communication circuit 106, so that the adjustment circuit 104 correspondingly adjusts, according to the time information and the preset relative delay time, the relative delay time between the data signal and the clock signal output by the data transmission transmitting end, so that the relative delay time meets the requirement of the preset relative delay time, and the data transmission receiving end can reliably collect data. Different preset relative delay time may be selected adaptively according to different data transmission statuses, to realize adaptive dynamic matching and meet the eye diagram requirements under various data transmission statuses. Meanwhile, excessive manual debugging is not needed with the help of automatic adjustment so as to save time and labor.

This embodiment provides a display device including a display panel and the delay adjustment circuit described in the foregoing embodiments, which ensures correct receiving of each displayed batch of data and improves display reliability.

The display panel described in this embodiment may be any of the following: a liquid crystal display panel, an OLED display panel, a QLED display panel, a Twisted Nematic (TN) display panel, a Super Twisted Nematic (STN) display panel, an In-Plane Switching (IPS) display panel, a Vertical Alignment (VA) display panel, a curved display panel, or other display panels.

Figure 5:
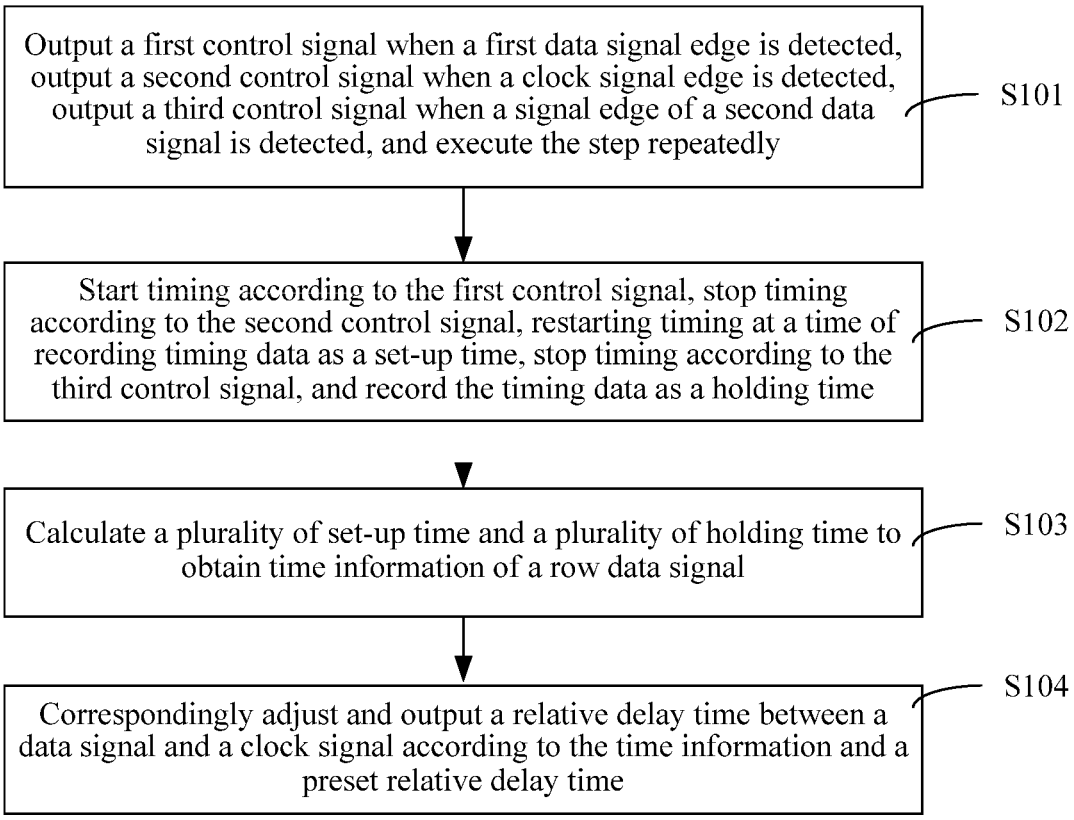
FIG. 5 is a flowchart of a method corresponding to the delay adjustment circuit in FIG. 1 according to an embodiment.

Referring to FIG. 5, FIG. 5 is a flowchart of a method corresponding to the delay adjustment circuit in FIG. 1 according to an embodiment.

In this embodiment, the delay adjustment method includes steps of S101, S102, S103 and S104, which are detailed as follows:

Step S101. Output a first control signal when a first data signal edge is detected, output a second control signal when a clock signal edge is detected, output a third control signal when a signal edge of a second data signal is detected, and execute the step repeatedly.

In this embodiment, in step S101, a data signal and a clock signal transmitted in a differential pair are received, the data signal and the clock signal are automatically detected, and a control signal is output when a data signal edge and a clock signal edge are detected. Specifically, the first control signal is output when the first data signal edge is detected, the second control signal is output when the clock signal edge is detected, the third control signal is output when the second data signal edge is detected, and the step is executed repeatedly at a period of the detection of the first data signal edge, the clock signal edge and the second data signal edge. The number of periods can be set specifically according to actual data signal transmission quality.

Step S102. Start timing according to the first control signal, stop timing according to the second control signal, restarting timing at a time of recording timing data as a set-up time, stop timing according to the third control signal, and record the timing data as a holding time.

In this embodiment, in step S102, timing is started according to the first control signal, stopped according to the second control signal, the timing data is recorded as a set-up time ($T_S$) and timing is restarted at the same time, and timing is stopped according to the third control signal, and the timing data is recorded as a holding time ($T_H$). The plurality of groups of set-up time and holding time data is recorded by periodically executing steps of: starting timing, stopping timing, and resetting at the same time, then restarting timing and stopping timing, and finally obtaining a relative delay status between a plurality of groups of data signals and clock signals of the data transmission receiving end. The set-up time ($T_S$) specifically refers to a time for which the data signal keeps stable and constant before a clock signal rising edge arrives. The holding time ($T_H$) specifically refers to a time for which data keeps stable and constant after the clock signal rising edge arrives.

Step S103. Calculate a plurality of set-up time and a plurality of holding time to obtain time information of a row data signal.

In this embodiment, in step S103, the plurality of set-up time and the plurality of holding time is calculated to obtain the time information of the row data signal. The plurality of set-up time may be equal or not, and the plurality of holding time may be equal or not. The calculation method includes but is not limited to a mean value method and a weighting method, and a combination thereof. The time information specifically refers to a relative delay status between a data signal and a clock signal of the data transmission receiving end, which includes but is not limited to a mean value or a weighted mean value of the plurality of set-up time, and a mean value or a weighted mean value of the plurality of holding time. For example, the mean value method may be adopted to calculate and obtain the mean value of the plurality of set-up time, specifically, $T_S=(T_1+T_2+\ldots+T_N)/N$. N is a positive integer and may be set according to actual situations. In step S103, the time information may be transmitted in real time, so that real-time and accurate adjustment may be realized to improve the delay accuracy. Alternatively, the time information may be selectively fed back in a non-data transmission period, that is, in an idle time in a horizontal or vertical direction, to avoid impact on data transmission.

Step S104. Correspondingly adjust and output a relative delay time between a data signal and a clock signal according to the time information and a preset relative delay time.

In this embodiment, in step S104, the relative delay time between the data signal and the clock signal that are output by the data transmission transmitting end is correspondingly adjusted according to the time information, so that the relative delay time meets the requirement of the preset relative delay time, and the data transmission receiving end can reliably collect data. Meanwhile, excessive manual debugging is not needed with the help of automatic adjustment so as to save time and labor. The preset relative delay time includes a preset set-up time and a preset holding time, which are set under different data transmission statuses in the actual application to meet the requirements of the data transmission diagram under various data transmission statuses.

In the delay adjustment method provided by this embodiment, the data signal edge and the clock signal edge are automatically detected, the plurality of groups of set-up time and holding time are recorded and calculated, the time information of the data transmission receiving end is obtained and fed back, and the relative delay time between the data signal and the clock signal is correspondingly adjusted and output according to the time information and the preset relative delay time, so that the relative delay time meets the requirement of the preset relative delay time, and the data transmission receiving end can reliably collect data, thereby improving data transmission quality. Different preset relative delay time may be selected adaptively according to different data transmission statuses to realize adaptive dynamic matching and meet the eye diagram requirements under various data transmission statuses. Meanwhile, excessive manual debugging is not needed with the help of automatic adjustment so as to save time and labor.

Figure 6:
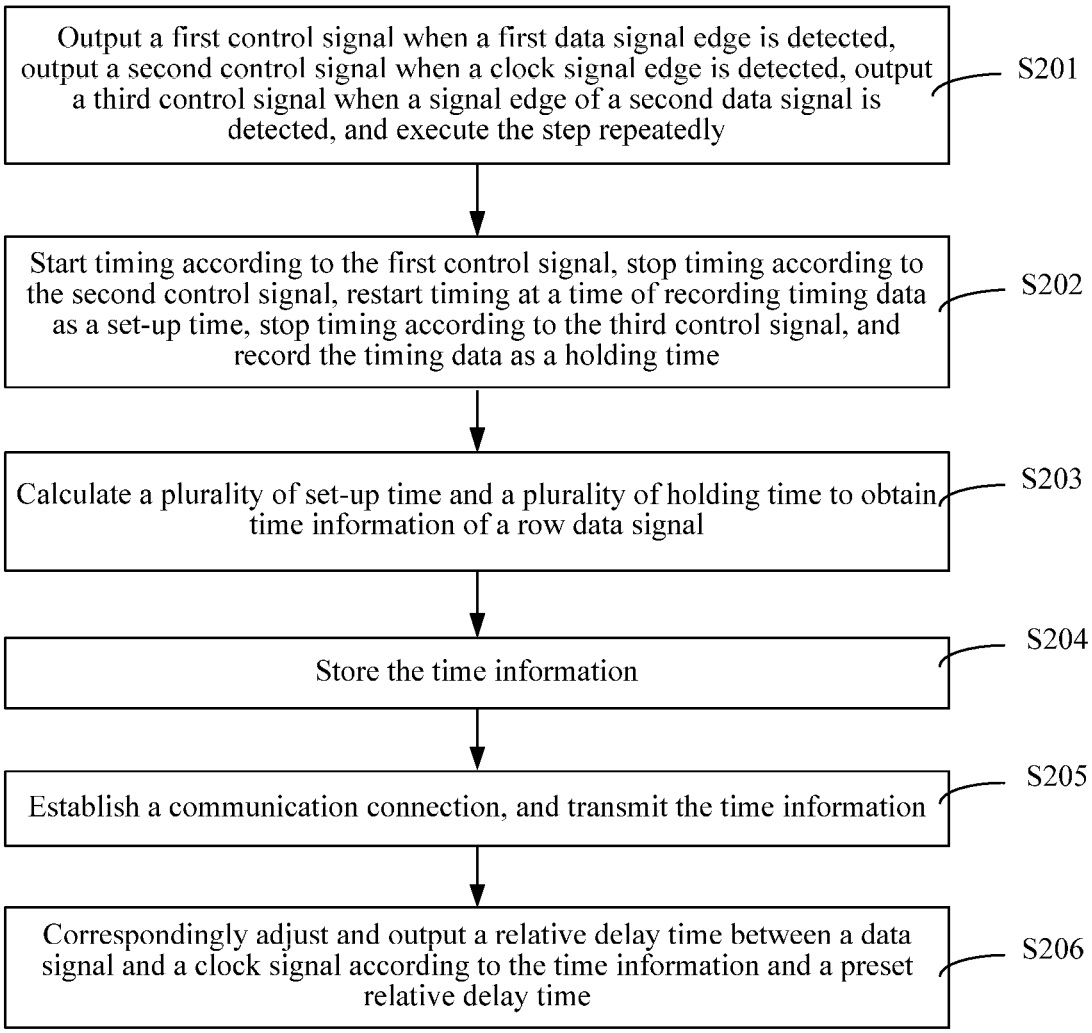
FIG. 6 is a flowchart of a method corresponding to the delay adjustment circuit in FIG. 4 according to another embodiment.

Referring to FIG. 6, FIG. 6 is a flowchart of a method corresponding to the delay adjustment circuit in FIG. 4 according to another embodiment.

In this embodiment, the delay adjustment method includes steps of: S201, S202, S203, S204, S205 and S206, which are detailed as follows:

Step S201. Output a first control signal when a first data signal edge is detected, output a second control signal when a clock signal edge is detected, output a third control signal when a signal edge of a second data signal is detected, and execute the step repeatedly.

Step S202. Start timing according to the first control signal, stop timing according to the second control signal, restart timing at a time of recording timing data as a set-up time, stop timing according to the third control signal, and record the timing data as a holding time.

Step S203. Calculate a plurality of set-up time and a plurality of holding time to obtain time information.

Step S204. Store the time information.

Step S205. Establish a communication connection, and transmit the time information Step S206. Correspondingly adjust and output a relative delay time between a data signal and a clock signal according to the time information and a preset relative delay time.

In this embodiment, for related descriptions of steps S201, S202, S203 and S206, refer to the related descriptions of steps S101, S102, S103 and S104 of the previous embodiment, and no more detailed description will be given herein.

In this embodiment, on one hand, the time information is stored in step S204 to avoid loss of the time information; on the other hand, more time information are stored for subsequent feedback, and a response is made immediately when the time information needs to be fed back, thereby improving the time information extraction efficiency.

In this embodiment, in step S205, a communication connection may be specifically established and the time information is transmitted in real time; or a communication connection is established and the time information is transmitted when data signal transmission is stopped. The communication connection can be established by using a bidirectional communication protocol, which includes but is not limited to an $I^2C$ protocol. During application of the communication protocol, lines of the communication protocol and to-be-transmitted data are separated and do not interfere with each other, so that the time information can be transmitted in real time when data are transmitted to achieve real-time accurate adjustment.

In the delay adjustment method provided by this embodiment, the data signal edge and the clock signal edge are automatically detected, the plurality of groups of set-up time and holding time are recorded, the plurality of groups of set-up time and holding time are calculated, the time information is obtained, stored, and fed back, and the relative delay time between the data signal and the clock signal is correspondingly adjusted and output according to the time information and the preset relative delay time, so that the relative delay time meets the requirement of the preset relative delay time, and the data transmission receiving end can reliably collect data. Different preset relative delay time may be selected adaptively according to different data transmission statuses to realize adaptive dynamic matching and meet the eye diagram requirements under various data transmission statuses. Meanwhile, excessive manual debugging is not needed with the help of automatic adjustment so as to save time and labor.

It should be understood that although the steps in the flowcharts of the foregoing embodiments are sequentially displayed in accordance with the indication of the arrows, these steps are not necessarily performed in the order indicated by the arrows. Unless otherwise specified in the specification, the execution of these steps is not strictly limited, and the steps may be performed in other orders. Moreover, at least some of the steps in FIG. 5 and FIG. 6 may include a plurality of sub-steps or stages, which are not necessarily performed at the same time, but may be performed at different times. The sub-steps or stages do need to be all performed sequentially, but may be performed sequentially or alternately with at least some of other steps or the sub-steps or stages of the other steps.

Technical features in the foregoing embodiments may be combined randomly. For the brevity of description, not all possible combinations of various technical features in the foregoing embodiments are described. However, provided that combinations of these technical features do not contradict each other, it should be considered that the combinations all fall within the scope of this specification.

The foregoing embodiments only show several implementations of this application and are described in detail, but they should not be construed as a limit to the patent scope of this application. It should be noted that, a person skilled in the art may make various changes and improvements without departing from the ideas of this application, which shall all fall within the protection scope of this application. Therefore, the protection scope of the patent of this application shall be subject to the appended claims.

What is claimed is:

1. A delay adjustment circuit, comprising:

a detection circuit disposed in a data driver and adapted to repeatedly output a first control signal when a first data signal edge is detected, output a second control signal when a clock signal edge is detected, output a third control signal when a second data signal edge is detected;

a timing circuit disposed in the data driver, coupled to the detection circuit and adapted to start timing according to the first control signal, stop timing according to the second control signal, restart timing at a time of recording timing data as a set-up time, stop timing according to the third control signal, and record the timing data as a holding time;

a calculation circuit disposed in the data driver, coupled to the timing circuit, and adapted to calculate set up times and holding times to obtain time information of a row data signal, wherein the time information comprises one of a mean value or a weighted mean value of the set-up times, and one of a mean value or a weighted mean value of the holding times; and an adjustment circuit disposed in a timing controller, coupled to the calculation circuit, and adapted to correspondingly adjust and output a relative delay time between a data signal and a clock signal according to the time information and a preset relative delay time.

2. The delay adjustment circuit according to claim 1 further comprising a storage circuit coupled to the calculation circuit and adapted to store the time information.

3. The delay adjustment circuit according to claim 1 further comprising a communication circuit coupled to the calculation circuit and the adjustment circuit and adapted to establish a communication connection between the calculation circuit and the adjustment circuit and transmit the time information.

4. The delay adjustment circuit according to claim 3, wherein the communication circuit comprises a bidirectional communication protocol.

5. The delay adjustment circuit according to claim 3, wherein the communication circuit comprises an inter-integrated circuit ($I^2C$) protocol.

6. The delay adjustment circuit according to claim 1, wherein the timing circuit comprises a counter.

7. The delay adjustment circuit according to claim 1, wherein the first data signal edge and the second data signal edge are edges of two adjacent data signals of a data transmission process.

8. The delay adjustment circuit according to claim 1, wherein the clock signal edge is a signal edge between the first data signal edge and the second data signal edge of a clock signal transmission process.

9. The delay adjustment circuit according to claim 1, wherein the row data signal is a set of all data signals transmitted during a preset time.

10. The delay adjustment circuit according to claim 1, wherein the preset relative delay time comprises a preset set-up time and a preset holding time.

11. A display device, including a display panel and the delay adjustment circuit according to claim 1.

12. A delay adjustment method, comprising:

repeatedly outputting, by a data driver, a first control signal when a first data signal edge is detected, outputting, by the data driver, a second control signal when a clock signal edge is detected, and outputting, by the data driver, a third control signal when a signal edge of a second data signal is detected;

starting timing according to the first control signal by the data driver, stopping timing according to the second control signal by the data driver, restarting the timing at a time of recording timing data as a set-up time by the data driver, stopping timing according to the third control signal by the data driver, and recording the timing data as a holding time by the data driver;

calculating, by the data driver, set-up times and holding times to obtain time information of a row data signal, wherein the time information comprises one of a mean value and a weighted mean value of the set-up times, and one of a mean value or a weighted mean value of the holding times; and correspondingly adjusting and outputting, by a timing controller, a relative delay time between a data signal and a clock signal according to the time information and a preset relative delay time.

13. The delay adjustment method according to claim 12, wherein the step of outputting, by a data driver, a first control signal when a first data signal edge is detected, outputting, by the data driver, a second control signal when a clock signal edge is detected, and outputting, by the data driver, a third control signal when a signal edge of a second data signal is detected is executed repeatedly during a period of the detection of the first data signal edge, the clock signal edge, and the second data signal edge.

14. The delay adjustment method according to claim 12, wherein after the step of calculating, by the data driver, set-up times and a holding times to obtain time information, the method further comprises:

storing the time information.

15. The delay adjustment method according to claim 12, wherein after the step of calculating, by the data driver, set-up times and a holding times to obtain time information, the method further comprises:

establishing a communication connection, and transmitting the time information.

16. The delay adjustment method according to claim 15, wherein the step of establishing a communication connection, and transmitting the time information is executed in real time; or is executed when the data signal transmission is stopped.

* * * * *